US010496029B2

(12) United States Patent
Watanabe

(10) Patent No.: US 10,496,029 B2
(45) Date of Patent: Dec. 3, 2019

(54) IMAGE FORMING APPARATUS

(71) Applicant: KYOCERA Document Solutions Inc., Osaka (JP)

(72) Inventor: Hiroaki Watanabe, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/276,806

(22) Filed: Feb. 15, 2019

(65) Prior Publication Data

US 2019/0278201 A1 Sep. 12, 2019

(30) Foreign Application Priority Data

Mar. 9, 2018 (JP) ..... 2018-043323

(51) Int. Cl.
*G03G 21/00* (2006.01)
*G03G 15/01* (2006.01)
*G03G 15/16* (2006.01)

(52) U.S. Cl.
CPC ..... *G03G 21/0005* (2013.01); *G03G 15/0189* (2013.01); *G03G 15/161* (2013.01)

(58) Field of Classification Search
CPC .. G03G 21/0005; G03G 21/007; G03G 21/10; G03G 21/0011; G03G 21/12; G03G 21/0029; G03G 2221/0005; G03G 2221/0026; G03G 2221/0047; G03G 2221/0068; G03G 2221/0089; G03G 2221/1627; G03G 2221/1648
See application file for complete search history.

(56) References Cited

U.S. PATENT DOCUMENTS

2008/0152378 A1* 6/2008 Yamashita ..... G03G 15/161 399/101
2009/0324279 A1* 12/2009 Miyahara ..... G03G 15/161 399/101

FOREIGN PATENT DOCUMENTS

JP 2016-090909 A 5/2016
JP 2016-206241 A 12/2016
JP 2016218247 A * 12/2016

* cited by examiner

*Primary Examiner* — Thomas S Giampaolo, II
(74) *Attorney, Agent, or Firm* — Studebaker & Brackett PC

(57) ABSTRACT

The image forming apparatus includes an image carrier, a transferring member and a cleaning device. The cleaning device includes a cleaning member, a case and a toner seal. A refresh mode including a first operation and a second operation is executable when an image forming operation is not performed. The first operation is executed such that the image carrier is rotated in a counter direction and for a predetermined distance or longer. The counter direction is a direction opposite to the rotation direction of the image carrier at the image forming operation. The predetermined distance is a distance from a contact position where the cleaning member comes into contact with the surface of the image carrier to a transferring position where the transferring member transfers the toner image. The second operation is executed such that the transferred body is driven and the transferring member is applied with transferring bias.

13 Claims, 3 Drawing Sheets

IMAGE FORMING APPARATUS

INCORPORATION BY REFERENCE

This application is based on and claims the benefit of priority from Japanese patent application No. 2018-043323, filed on Mar. 9, 2018, which is incorporated by reference in its entirety.

BACKGROUND

The present disclosure relates to an electrophotographic type image forming apparatus.

In an electrophotographic type image forming apparatus, a toner image carried on a surface of an image carrier, such as a photosensitive drum, is conventionally transferred to a transferred body by a transferring member. A toner remaining on the surface of the image carrier after the toner image is transferred is removed by a cleaning member.

"Filming" and "uneven abrasion" may be recited as problems about development of the image carrier. The filming is a phenomenon that additive, toner component, paper dust and the others are adhered on the surface of the image carrier and they appear on an image as a color point. The uneven abrasion is a phenomenon that the image carrier is unevenly abraded along its longitudinal direction. The uneven abrasion causes unevenness in surface potential of the image carrier owing to a difference in film thickness of the image carrier, and the unevenness in surface potential causes unevenness in density of the image. One of the main reasons of the uneven abrasion is uneven dispersion of an abrasive at an edge portion of the cleaning member.

SUMMARY

In accordance with an aspect of the present disclosure, an image forming apparatus includes an image carrier, a transferring member and a cleaning device. The image carrier is configured to be rotatable and has a surface on which a toner image is carried. The transferring member is configured to transfer the toner image carried on the surface of the image carrier to a transferred body. The cleaning device is configured to remove the toner remaining on the surface of the image carrier. The cleaning device includes a cleaning member, a case and a toner seal. The cleaning member is configured to come into contact with the surface of the image carrier. The case is configured to hold the cleaning member. The toner seal is arranged at an upstream side of the cleaning member in a rotation direction of the image carrier at an image forming operation and configured to come into contact with the surface of the image carrier so as to seal a gap between the surface of the image carrier and the case. A refresh mode including a first operation and a second operation is executable when the image forming operation is not performed. The first operation is executed such that the image carrier is rotated in a counter direction and for a predetermined distance or longer. The counter direction is a direction opposite to the rotation direction of the image carrier at the image forming operation. The predetermined distance is a distance from a contact position where the cleaning member comes into contact with the surface of the image carrier to a transferring position where the transferring member transfers the toner image. The second operation is executed such that, after the first operation is completed, the transferred body is driven and the transferring member is applied with transferring bias.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, an image forming apparatus 1 according to an embodiment of the present disclosure will be described. Arrows L, R, U and Lo suitably marked in each figure respectively indicate a left side, a right side, an upper side and a lower side of the image forming apparatus 1.

First, an entire structure of the image forming apparatus 1 will be described. The image forming apparatus 1 is a multifunctional peripheral multiply having a printing function, a copying function, a facsimile function and the other functions.

Figure 1:
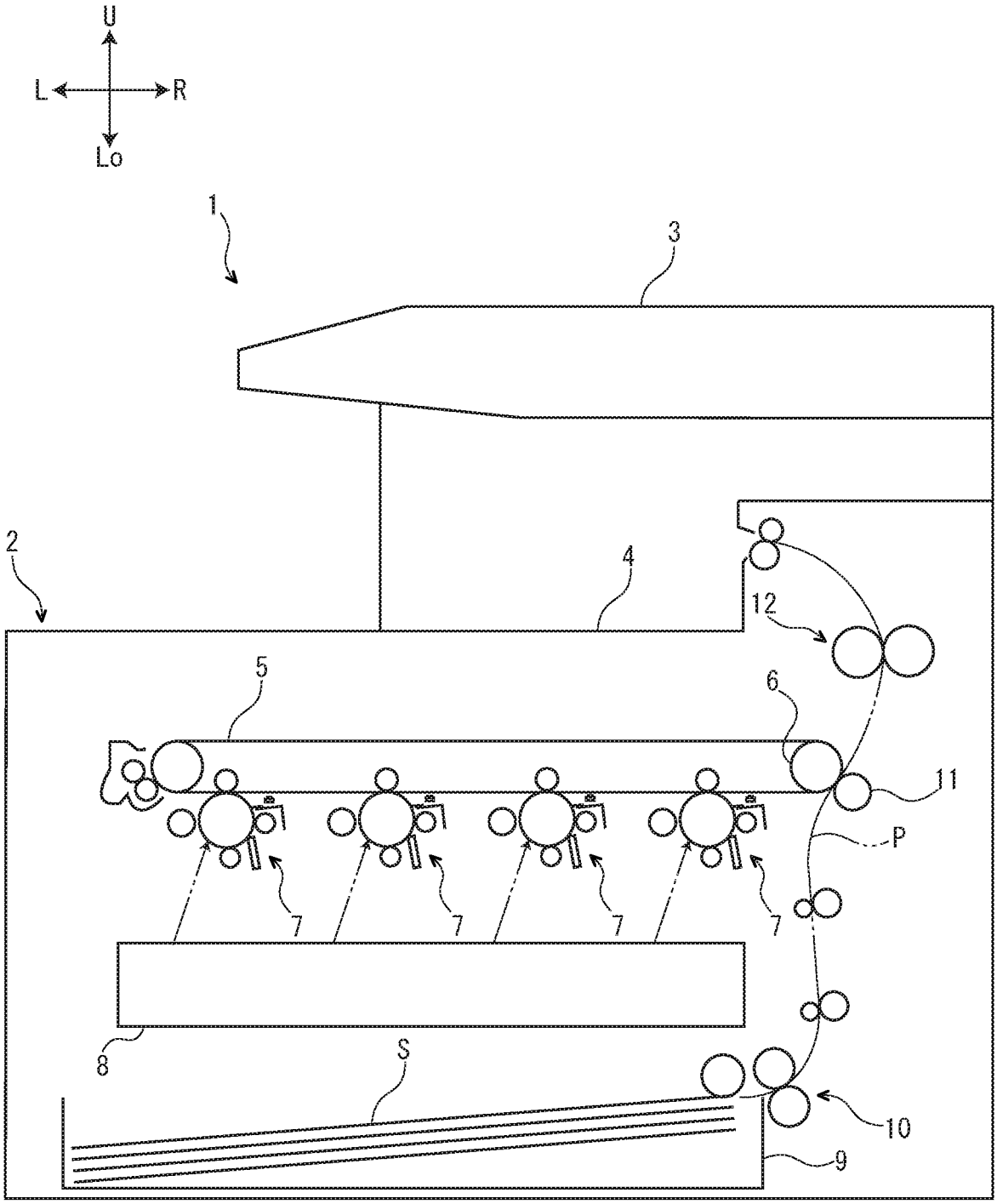
FIG. 1 is a schematic view showing an image forming apparatus according to an embodiment of the present disclosure.

As shown in FIG. 1, the image forming apparatus 1 includes a box-shaped apparatus main body 2. At an upper end portion of the apparatus main body 2, an image reading device 3 configured to read an image of a document is provided. In an upper portion of the apparatus main body 2, an ejected sheet tray 4 is provided. In an approximately center portion of the apparatus main body 2, an intermediate transferring belt 5 (an example of a transferred body) is stored. A right end portion of the intermediate transferring belt 5 is wound around a drive roller 6. In the approximately center portion of the apparatus main body 2, four image forming parts 7 are stored below the intermediate transferring belt 5. The respective image forming parts 7 correspond to toners of black, cyan, magenta and yellow. In a lower portion of the apparatus main body 2, an exposure device 8 is stored. In a lower end portion of the apparatus main body 2, a sheet feeding cassette 9 storing a sheet S (an example of a recording medium) is stored.

In a right side portion of the apparatus main body 2, a conveying path P for the sheet S is provided. At an upstream end portion of the conveying path P, a sheet feeding part 10 is provided. At a midstream portion of the conveying path P, a secondary transferring roller 11 is provided. At a downstream portion of the conveying path P, a fixing device 12 is provided.

Next, an operation of the image forming apparatus 1 will be described.

First, light (refer to a two-dotted chain line arrow in FIG. 1) from the exposure device 8 forms an electrostatic latent image at each image forming part 7. The electrostatic latent image is developed to a toner image at each image forming part 7. The toner image is primarily transferred on the intermediate transferring belt 5 from each image forming part 7. Thereby, a full color toner image is formed on the intermediate transferring belt 5.

On the other hand, the sheet S fed from the sheet feeding cassette 9 by the sheet feeding part 10 is conveyed to a downstream side along the conveying path P and then enters a nip area between the intermediate transferring belt 5 and the secondary transferring roller 11. The secondary transferring roller 11 secondarily transfers the full color toner image formed on the intermediate transferring belt 5 to the sheet S. The sheet S on which the toner image is secondarily transferred is further conveyed to the downstream side along the conveying path P and then enters the fixing device 12. The fixing device 12 fixes the toner image on the sheet S. The sheet S on which the toner image is fixed is ejected on the ejected sheet tray 4.

Next, the image forming part 7 will be described.

Figure 2:
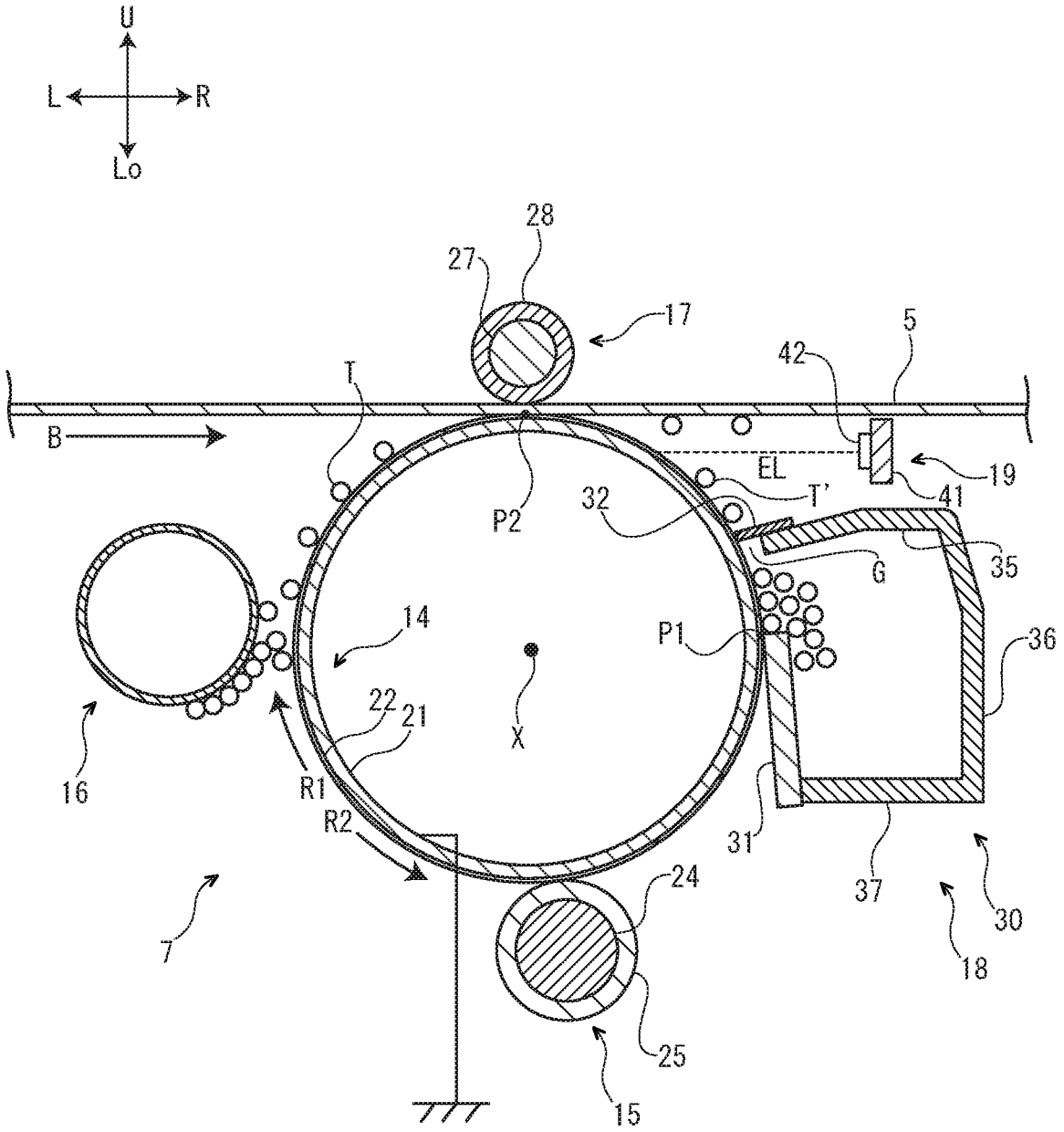
FIG. 2 is a sectional view showing an image forming part according to the embodiment of the present disclosure.

With reference to FIG. 2, the image forming part 7 includes a photosensitive drum 14 (an example of an image carrier), a charge roller 15 (an example of a charge member) provided at the lower side of the photosensitive drum 14, a development roller 16 (an example of a development member) provided at the left side of the photosensitive drum 14, a primary transferring roller 17 (an example of a transferring member) provided at the upper side of the photosensitive drum 14, a cleaning device 18 provided at the right side of the photosensitive drum 14 and a static eliminator 19 provided at the right upper side of the photosensitive drum 14.

The photosensitive drum 14 of the image forming part 7 has a cylindrical shape. The photosensitive drum 14 is rotatable around a rotation axis X extending along a front-and-rear direction. That is, in the present embodiment, the front-and-rear direction is a rotation axis direction of the photosensitive drum 14. An arrow R1 in FIG. 2 shows a rotation direction of the photosensitive drum 14 when the image forming operation is performed, and an arrow R2 in FIG. 2 shows the rotation direction of the photosensitive drum 14 when a refresh mode is executed.

The photosensitive drum 14 includes a base layer 21 and a photosensitive layer 22 covering an outer circumference of the base layer 21. The base layer 21 is formed by metal, for example, and electrically grounded. The photosensitive layer 22 is formed by positively charged single layer type organic photoconductor, for example. Hereinafter, a surface of the photosensitive layer 22 is called "a surface of the photosensitive drum 14".

The charge roller 15 of the image forming part 7 has a columnar shape. The charge roller 15 is rotatable. The charge roller 15 includes a core metal 24 and an elastic layer 25 covering an outer circumference of the core metal 24. The core metal 24 is formed by metal, for example. The elastic layer 25 is formed by elastic material, such as epichlorohydrin rubber, and has electrical conductivity. An outer circumferential face of the elastic layer 25 comes into contact with the surface of the photosensitive drum 14.

The development roller 16 of the image forming part 7 has a cylindrical shape. The development roller 16 is rotatable. An outer circumferential face of the development roller 16 faces the surface of the photosensitive drum 14 via a space. Inside the development roller 16, a non-rotatable magnetic pole (not shown) is stored.

Between the primary transferring roller 17 of the image forming part 7 and the photosensitive drum 14, the intermediate transferring belt 5 is put. The primary transferring roller 17 is rotatable. The primary transferring roller 17 includes a core metal 27 and an elastic layer 28 covering an outer circumference of the core metal 27. The core metal 27 is formed by metal, for example. The elastic layer 28 is formed by elastic material, such as ethylene-propylene rubber, and has electrical conductivity.

The cleaning device 18 of the image forming part 7 includes a case 30, a cleaning blade 31 (an example of a cleaning member) held by a left lower portion of the case 30 and a toner seal 32 held at a left upper portion of the case 30.

The case 30 of the cleaning device 18 is opened to the left side (the side of the photosensitive drum 14), and has a cross section of an approximately U-shape. The case 30 includes an upper wall 35 extending along the left-and-right direction, a side wall 36 bent to the lower side from a right end portion of the upper wall 35 and a bottom wall 37 bent to the left side from a lower end portion of the side wall 36. A left end portion of the upper wall 35 faces the surface of the photosensitive drum 14 via a gap G.

The cleaning blade 31 of the cleaning device 18 is formed by urethane rubber, for example. The cleaning blade 31 is fixed to a left end portion of the bottom wall 37 of the case 30. An edge portion (a tip end portion) of the cleaning blade 31 comes into contact with the surface of the photosensitive drum 14.

The toner seal 32 of the cleaning device 18 is arranged at a downstream side of the primary transferring roller 17 and at an upstream side of the cleaning blade 31 in the rotation direction (refer to the arrow R1 in FIG. 2) of the photosensitive drum 14 at the image forming operation. The toner seal 32 is formed by urethane sheet, for example. The toner seal 32 has a thickness of 0.1 mm to 0.2 mm, for example. A base end portion of the toner seal 32 is fixed to the left end portion of the upper wall 35 of the case 30. A tip end portion of the toner seal 32 comes into contact with the surface of the photosensitive drum 14. That is, the toner seal 32 seals the gap G between the surface of the photosensitive drum 14 and the left end portion of the upper wall 35 of the case 30. This inhibits leakage of the toner from the case 30.

The static eliminator 19 of the image forming part 7 is arranged between the intermediate transferring belt 5 and the upper wall 35 of the case 30 of the cleaning device 18. The static eliminator 19 is arranged at the downstream side of the primary transferring roller 17 and at the upstream side of the cleaning device 18 in the rotation direction (refer to the arrow R1 in FIG. 2) of the photosensitive drum 14 at the image forming operation. The static eliminator 19 includes aboard 41 and a plurality of light emitting elements 42 mounted on the board 41. The board 41 has a flat plate shape elongated in the front-and-rear direction. The light emitting elements 42 are aligned along the front-and-rear direction. Each light emitting element 42 is composed of a chip-type light emitting diode (LED), for example.

Next, a control system of the image forming apparatus 1 will be described.

Figure 3:
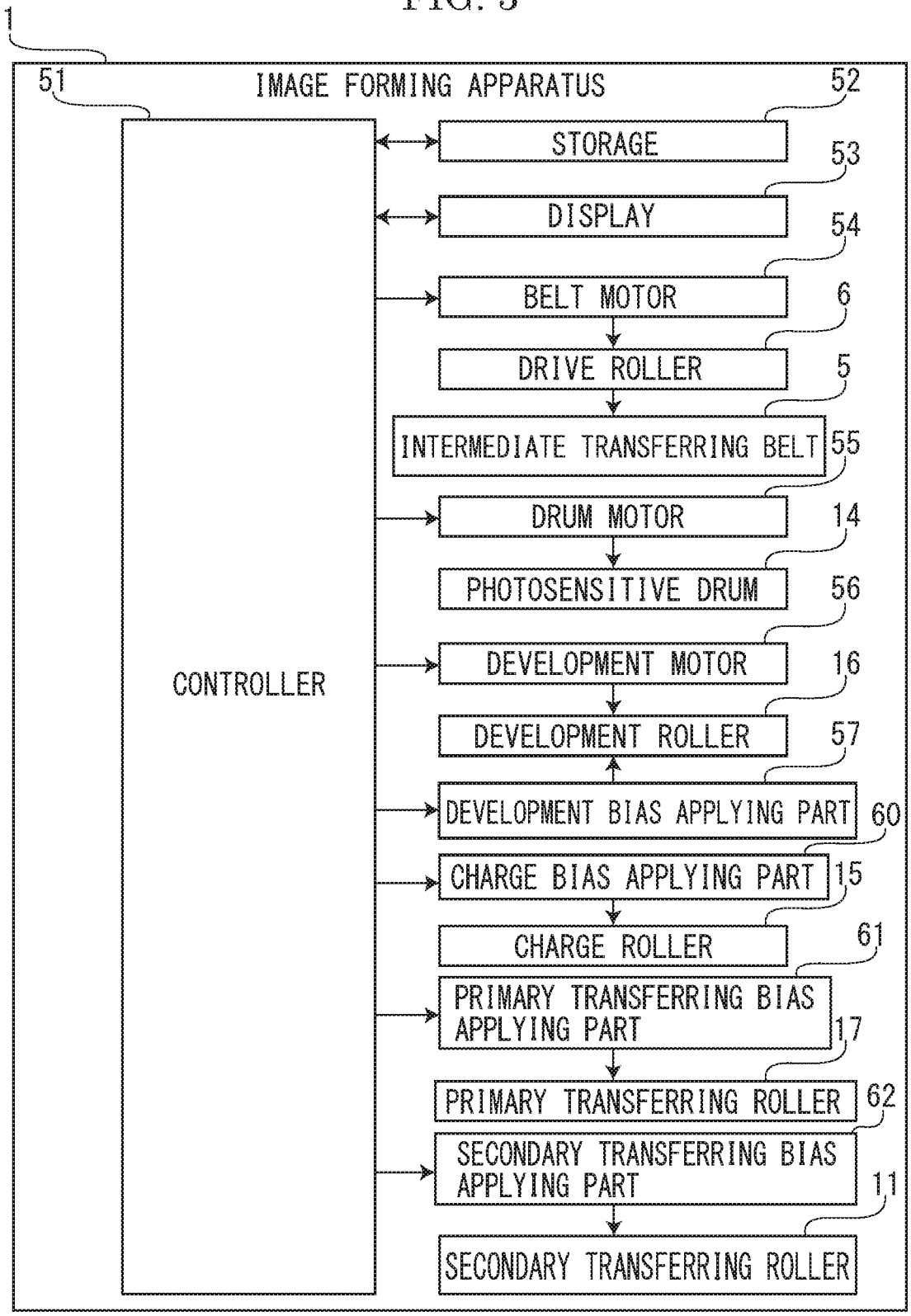
FIG. 3 is a block diagram showing a control system of the image forming apparatus according to the embodiment of the present disclosure.

With reference to FIG. 3, the image forming apparatus 1 includes a controller 51. The controller 51 is constructed by a central processing unit (CPU), for example.

The controller 51 is connected to a storage 52. The storage 52 includes a random access memory (RAM) and a read only memory (ROM), for example.

The controller 51 is connected to a display 53. The display 53 is constructed by a liquid crystal display (LCD), for example. The display 53 displays various screens (for example, an operation screen and an error message screen) based on a signal from the controller 51.

The controller 51 is connected to a belt motor 54. The belt motor 54 is connected to the drive roller 6. When the belt motor 54 rotates the drive roller 6 based on a signal from the controller 51, the intermediate transferring belt 5 is driven by the rotation of the drive roller 6. That is, based on the signal from the controller 51, the belt motor 54 drives the intermediate transferring belt 5.

The controller 51 is connected to a drum motor 55. The drum motor 55 is connected to the photosensitive drum 14, and rotates the photosensitive drum 14 based on a signal from the controller 51.

The controller 51 is connected to a development motor 56. The development motor 56 is connected to the development roller 16, and rotates the development roller 16 based on a signal from the controller 51.

The controller 51 is connected to a development bias applying part 57. The development bias applying part 57 is connected to the development roller 16, and applies development bias to the development roller 16 based on a signal from the controller 51. The development bias has the same polarity as a charge polarity of the toner.

The controller 51 is connected to a charge bias applying part 60. The charge bias applying part 60 is connected to the charge roller 15, and applies charge bias to the charge roller 15 based on a signal from the controller 51. The charge bias has the same polarity as the charge polarity of the toner.

The controller 51 is connected to a primary transferring bias applying part 61. The primary transferring bias applying part 61 is connected to the primary transferring roller 17, and applies primary transferring bias to the primary transferring roller 17 based on a signal from the controller 51. The primary transferring bias has the same polarity as or an opposite polarity to the charge polarity of the toner.

The controller 51 is connected to a secondary transferring bias applying part 62. The secondary transferring bias applying part 62 is connected to the secondary transferring roller 11, and applies secondary transferring bias to the secondary transferring roller 11 based on a signal from the controller 51. The secondary transferring bias has the same polarity as or an opposite polarity to the charge polarity of the toner.

Next, in the image forming apparatus 1 having the above described configuration, an example of an image forming operation will be described.

When the image forming operation is performed, the drum motor 55 rotates the photosensitive drum 14 (refer to the arrow R1 in FIG. 2). Then, the charge roller 15 is driven by the photosensitive drum 14 to be rotated. Additionally, the charge bias applying part 60 applies the charge bias to the charge roller 15. Thereby, the charge roller 15 charges the surface of the photosensitive drum 14 uniformly.

When the image forming operation is performed, the exposure device 8 exposes the uniformly charged surface of the photosensitive drum 14. This forms an electrostatic latent image on the surface of the photosensitive drum 14.

When the image forming operation is performed, the development motor 56 rotates the development roller 16 and the development bias applying part 57 applies the development bias to the development roller 16. Thereby, the toner T is supplied from the development roller 16 to the surface of the photosensitive drum 14, the electrostatic latent image formed on the surface of the photosensitive drum 14 is developed, and a toner image is carried on the surface of the photosensitive drum 14.

When the image forming operation is performed, the belt motor 54 drives the intermediate transferring belt 5 (refer to an arrow B in FIG. 2), and the primary transferring bias applying part 61 applies the primary transferring bias (the opposite polarity to the charge polarity of the toner) to the primary transferring roller 17. Thereby, the toner image carried on the surface of the photosensitive drum 14 is primarily transferred on the intermediate transferring belt 5 by the primary transferring roller 17.

When the image forming operation is performed, the secondary transferring bias applying part 62 applies the secondary transferring bias (the opposite polarity to the charge polarity of the toner) to the secondary transferring roller 11. Thereby, the toner image primarily transferred on the intermediate transferring belt 5 is secondarily transferred on the sheet S by the secondary transferring roller 11.

When the image forming operation is performed, the photosensitive drum 14 rotates with respect to the cleaning blade 31 of the cleaning device 18. Thereby, the edge portion of the cleaning blade 31 polishes the surface of the photosensitive drum 14 and removes the remaining toner T' (the toner remaining on the surface of the photosensitive drum 14 after the primary transferring).

When the image forming operation is performed, the static eliminator 19 is operated. Then, each light emitting element 42 of the static eliminator 19 emits elimination light EL to the surface of the photosensitive drum 14 (refer to FIG. 2). When the surface of the photosensitive drum 14 is irradiated with the elimination light EL, the remaining charge (the charge remaining on the surface of the photosensitive drum 14 after the primary transferring) is eliminated from the surface of the photosensitive drum 14.

By the way, in the present embodiment, the toner is mixed with additive. Then, at an area where a large amount of the additive flies from the development roller 16 to the surface of the photosensitive drum 14 (for example, a non-exposed area of the surface of the photosensitive drum 14), a large amount of the additive reaches the edge portion of the cleaning blade 31. Because the additive contains abrasive, at an area where a large amount of the additive reaches the edge portion of the cleaning blade 31, an amount of the abrasive that reaches the edge portion of the cleaning blade 31 is increased. As a result, an abrasion amount of the photosensitive drum 14 is larger at the above area than at the other area. This causes uneven abrasion of the photosensitive drum 14. Accordingly, in order to eliminate the uneven abrasion of the photosensitive drum 14, it is required to eliminate uneven dispersion of the amount of the abrasive at the edge portion of the cleaning blade 31. Then, in the present embodiment, when the image forming operation is not performed, the refresh mode is executed to eliminate the uneven dispersion of the amount of the abrasive at the edge portion of the cleaning blade 31.

Hereinafter, an example of the refresh mode will be described.

When the refresh mode is executed, first, the drum motor 55 rotates the photosensitive drum 14 in a counter direction (refer to the arrow R2 in FIG. 2) and for a distance longer than a predetermined distance. The counter direction is a direction opposite to the rotation direction at the image forming operation. The predetermined distance is a distance in a circumferential direction from a contact position P1 where the edge portion of the cleaning blade 31 comes into contact with the surface of the photosensitive drum 14 to a transferring position P2 where the primary transferring roller 17 transfers the toner image (a nip position between the photosensitive drum 14 and the intermediate transferring belt 5). Hereinafter, the above operation is called "a first operation". In the present embodiment, when the first operation is executed, the drive of the intermediate transferring belt 5 is stopped.

When the first operation is executed, the abrasive accumulated near the contact position P1, where the edge portion of the cleaning blade 31 comes into contact with the surface of the photosensitive drum 14, is conveyed by the photosensitive drum 14 and comes into contact with the toner seal 32. This breaks the accumulated abrasive. The abrasive passed through the toner seal 32 is moved to the transferring position P2, where the primary transferring roller 17 transfers the toner image, and intercepted by the photosensitive drum 14 and the intermediate transferring belt 5.

When the first operation is completed, after the drum motor 55 stops the rotation of the photosensitive drum 14 once, the drum motor 55 rotates the photosensitive drum 14 in the same direction as the rotation direction at the image forming operation (refer to the arrow R1 in FIG. 2).

Next, the belt motor 54 drives the intermediate transferring belt 5 (refer to the arrow B in FIG. 2) and the primary transferring bias applying part 61 applies the primary transferring bias (the same charge polarity as the charge polarity of the toner) to the primary transferring roller 17. Hereinafter, the above operation is called "a second operation".

When the second operation is executed, the abrasive intercepted by the photosensitive drum 14 and the intermediate transferring belt 5 is transferred from the surface of the photosensitive drum 14 to the intermediate transferring belt 5, and conveyed by the intermediate transferring belt 5. Thereby, the abrasive is removed from the surface of the photosensitive drum 14 so that the uneven dispersion of the amount of the abrasive at the edge portion of the cleaning blade 31 is eliminated.

As described above, the image forming apparatus 1 of the present embodiment is configured such that the refresh mode including the first operation and the second operation is executable when the image forming operation is not performed. The first operation is executed such that the photosensitive drum 14 is rotated in the counter direction opposite to the rotation direction at the image forming operation and for the distance longer than the predetermined distance in the circumferential direction from the contact position P1 where the edge portion of the cleaning blade 31 comes into contact with the surface of the photosensitive drum 14 to the transferring position P2 where the primary transferring roller 17 transfers the toner image. The second operation is executed such that, after the first operation is completed, the intermediate transferring belt 5 is driven and the primary transferring roller 17 is applied with the primary transferring bias. By executing the refresh mode, it becomes possible to break the abrasive accumulated near the contact position P1, where the edge portion of the cleaning blade 31 comes into contact with the surface of the photosensitive drum 14, by the toner seal 32 and then to collect it by the intermediate transferring belt 5. Accordingly, it becomes possible to eliminate the uneven dispersion of the amount of the abrasive at the edge portion of the cleaning blade 31 and to eliminate the uneven abrasion of the photosensitive drum 14.

As described above, when the first operation is executed, because the photosensitive drum 14 rotates in the counter direction opposite to the rotation direction at the image forming operation, a large difference in linear speed between the photosensitive drum 14 and the intermediate transferring belt 5 is produced so that the surface of the photosensitive drum 14 can be polished by the intermediate transferring belt 5. Accordingly, it becomes possible to prevent the additive, the toner component, the paper dust and the like from being adhered on the surface of the photosensitive drum 14 and to eliminate occurrence of filming.

Additionally, it becomes possible to eliminate the uneven abrasion and the filming without using a detecting device for detecting a difference of film thickness of the photosensitive drum 14 so that an increase in number of members is eliminated to prevent an increase in cost. That is, the image forming apparatus 1 of the present embodiment makes it possible to eliminate the filming and the uneven abrasion without increasing the cost and to prolong a life of the photosensitive drum 14.

In the present embodiment, the second operation is executed after the rotation (in the counter direction opposite to the rotation direction at the image forming operation) of the photosensitive drum 14 for the first operation is stopped. By applying such a configuration, the second operation makes it possible to transfer the abrasive from the surface of the photosensitive drum 14 to the intermediate transferring belt 5 surely.

In the present embodiment, the toner seal 32 has a thickness of 0.1 mm or thicker. By applying such a configuration, it becomes possible to improve rigidity of the toner seal 32 and to heighten an effect for braking the accumulated abrasive by the toner seal 32.

In the present embodiment, the primary transferring bias applied to the primary transferring roller 17 at the second operation has an opposite polarity to the polarity of the primary transferring bias applied to the primary transferring roller 17 at the image forming operation. Accordingly, the second operation makes it possible to transfer the abrasive charged with the opposite polarity to the charge polarity of the toner from the surface of the photosensitive drum 14 to the intermediate transferring belt 5 effectively.

In the present embodiment, the second operation is executed after the rotation (in the counter direction opposite to the rotation direction at the image forming operation) of the photosensitive drum 14 for the first operation is stopped. On the other hand, in another embodiment, the second operation may be executed while the rotation of the photosensitive drum 14 (in the counter direction opposite to the rotation direction at the image forming operation) for the first operation is continued. By applying such a configuration, compared with a case where the second operation is executed after the rotation (in the counter direction opposite to the rotation direction at the image forming operation) of the photosensitive drum 14 for the first operation is stopped, it becomes possible to bring a start timing of the second operation forward. Accordingly, it becomes possible to shorten an execution time of the refresh mode and a waiting time for the user.

In the present embodiment, the transferring bias applied to the primary transferring roller 17 at the second operation has an opposite polarity to the polarity of the transferring bias applied to the primary transferring roller 17 at the image forming operation. On the other hand, in another embodiment, if the abrasive is easy to be charged with the same polarity as the charge polarity of the toner, the transferring bias applied to the primary transferring roller 17 at the second operation may be the same polarity as the polarity of the transferring bias applied to the primary transferring roller 17 at the image forming operation. As described above, the transferring bias applied to the primary transferring roller 17 at the second operation may be changed suitably for a property of the used abrasive.

In the present embodiment, when the first operation is executed, the drive of the intermediate transferring belt 5 is stopped. On the other hand, in another embodiment, when the first operation is executed, the intermediate transferring belt 5 may be driven in the same direction as that at the image forming operation. By applying such a configuration, a difference in linear speed between the photosensitive drum 14 and the intermediate transferring belt 5 at the first operation is larger than that in a case where the drive of the intermediate transferring belt 5 is stopped at the first operation. This makes it possible to heighten an effect for eliminating the filming.

In the present embodiment, when the first operation is executed, the photosensitive drum 14 is rotated in the counter direction opposite to the rotation direction of the photosensitive drum 14 at the image forming operation and for a distance longer than a predetermined distance in the circumferential direction from the contact position P1 where the edge portion of the cleaning blade 31 comes into contact with the surface of the photosensitive drum 14 to the transferring position P2 where the primary transferring roller 17 transfers the toner image. On the other hand, in another embodiment, when the first operation is executed, the photosensitive drum 14 may be rotated in the counter direction opposite to the rotation direction of the photosensitive drum 14 at the image forming operation and for a distance equal to the predetermined distance in the circumferential direction from the contact position P1 where the edge portion of the cleaning blade 31 comes into contact with the surface of the photosensitive drum 14 to the transferring position P2 where the primary transferring roller 17 transfers the toner image.

In the present embodiment, when the second operation is executed, the photosensitive drum 14 is rotated in the same direction as the rotation direction at the image forming operation. On the other hand, in another embodiment, when the second operation is executed, the rotation of the photosensitive drum 14 may be stopped.

In the present embodiment, the first operation and the second operation are executed as one set. On the other hand, in another embodiment, the first operation and the second operation may not be executed as one set. In the other words, in the present embodiment, the second operation is continuously executed after the first operation is completed. In another embodiment, the second operation may be executed after a predetermined time elapses since the first operation is completed.

However, when the first operation and the second operation are not executed as one set (the second operation is executed after a predetermined time elapses since the first operation is completed), after the first operation is completed, it is desirable that information showing that the first operation is completed be stored in the storage 52. Then, if the first operation and the second operation are not executed as one set, it becomes possible to surely execute the second operation after the first operation is completed and to surely transfer the abrasive from the surface of the photosensitive drum 14 to the intermediate transferring belt 5.

In a state where the intermediate transferring belt 5 is driven, if the primary transferring bias is applied to the primary transferring roller 17 while the photosensitive drum 14 is rotated in the counter direction opposite to the rotation direction at the image forming operation, the abrasive transferred from the surface of the photosensitive drum 14 to the intermediate transferring belt 5 is conveyed by the intermediate transferring belt 5. Accordingly, in this case, when the intermediate transferring belt 5 is driven next time, it is not required to apply the primary transferring bias to the primary transferring roller 17. On the other hand, in a state where the drive of the intermediate transferring belt 5 is stopped, if the photosensitive drum 14 is rotated in the counter direction opposite to the rotation direction at the image forming operation, the abrasive is not transferred from the surface of the photosensitive drum 14 to the intermediate transferring belt 5. Accordingly, in this case, at least when the intermediate transferring belt 5 is driven next time, it is desirable that the primary transferring roller 17 be applied with the primary transferring bias so as to transfer the abrasive from the surface of the photosensitive drum 14 to the intermediate transferring belt 5.

In the present embodiment, each of the first operation and the second operation is executed once. On the other hand, in another embodiment, the first operation and the second operation may be executed repeatedly and alternately.

In the present embodiment, the image forming apparatus 1 is a multifunctional peripheral. On the other hand, in another embodiment, the image forming apparatus 1 may be a printer, a copying machine or a facsimile.

EXPERIMENT

An experiment to demonstrate an effect of the present disclosure was carried out by using the image forming apparatus 1 of the present embodiment.

Experimental Condition

The detail of the image forming apparatus 1 used for the experiment is follows:

A linear speed of the surface of the photosensitive drum 14: 210 (mm/sec),

Material of the photosensitive layer 22 of the photosensitive drum 14: positively charged single layer type organic photoconductor, A diameter of the photosensitive drum 14: 30 (mm), Material of the elastic layer 25 of the charge roller 15: epichlorohydrin rubber, A diameter of the charge roller 15: 12 (mm), Charge potential of the charge roller 15: +520 (V), Material of the cleaning blade 31: urethane rubber, A thickness of the cleaning blade 31: 2.0 (mm), JIS-A hardness of the cleaning blade 31: 72(°, Impact resilience of the cleaning blade 31: 24 (%) (measured under an environment of a temperature of 23 (° C.)), Material of the toner seal 32: urethane, and A thickness of the toner seal 32: 0.1 (mm).

Experiment 1

An experiment 1 was carried out to demonstrate an effect of polishing operation of the photosensitive drum 14 on the filming. It is known that the image forming apparatus 1 used for this experiment has a property that when an image pattern having a high printing ratio is repeatedly printed, the filming occurs easily. Then, in the experiment 1, in each of cases where the polishing operation of the photosensitive drum 14 was performed and not performed, 10,000 sheets were printed at various printing ratio, and then whether the filming occurred or not was judged visually. In the case where the polishing operation was performed, the drive of the intermediate transferring belt 5 was stopped once every time when 50 sheets printing was completed, and then the photosensitive drum 14 was rotated in the counter direction opposite to the rotation direction at the image forming operation for 30 seconds. A result of the experiment 1 is shown in table 1.

TABLE 1

| | | Printing ratio (%) | | | |
|---|---|---|---|---|---|
| | | 25 | 50 | 75 | 100 |
| Polishing operation of photosensitive drum 14 | performed | ○ | ○ | x | x |
| | not performed | ○ | ○ | ○ | ○ |

A mark "○" in table 1 shows that the filming did not occur, and a mark "x" in table 1 shows that the filming occurred. As shown in table 1, the filming occurs more easily as the printing ratio is increased. However, by performing the polishing operation of the photosensitive drum 14, the occurrence of the filming was eliminated. This is probably because the photosensitive drum 14 is rotated in the counter direction opposite to the rotation direction at the image forming operation periodically so that the surface of the photosensitive drum 14 is polished and the adhesive on the surface of the photosensitive drum 14 is removed.

Experiment 2

An experiment 2 was carried out to demonstrate an effect of the toner seal 32 on the uneven abrasion and the filming. In the experiment 2, 200,000 sheets were printed at various thicknesses of the toner seal 32, and then whether the uneven abrasion occurred or not was judged by the following way. That is, the photosensitive drum 14 was checked for the thickness at several portions in a longitudinal direction of the photosensitive drum 14, and in a case where a difference in thickness between the thickest portion and the thinnest portion was 5 μm or larger, it was judged that the uneven abrasion occurred, and in a case where the above difference was less than 5 μm, it was judged that the uneven abrasion did not occur. Additionally, in the experiment 2, 200,000 sheets were printed at various thicknesses of the toner seal 32 in the above described manner, and then whether the filming occurred or not was judged visually, in the same way as the experiment 1. In the experiment 2, the polishing operation of the photosensitive drum 14 was performed in the same manner as the case where the polishing operation of the photosensitive drum 14 was performed in the experiment 1. A result of the experiment 2 is shown in table 2.

TABLE 2

| Thickness of toner seal 32 (mm) | Uneven abrasion | Filming |
|---|---|---|
| Toner seal 32 was not used | x | ○ |
| 0.05 | x | ○ |
| 0.10 | ○ | ○ |
| 0.15 | ○ | ○ |
| 0.20 | ○ | ○ |

A mark "○" in a column of "uneven abrasion" in table 2 shows that the uneven abrasion did not occur, and a mark "x" in the column of "uneven abrasion" in table 2 shows that the uneven abrasion occurred. A mark "○" in a column of "filming" in table 2 shows that the filming did not occur. As shown in table 2, an increase of the thickness of the toner seal 32 eliminates the uneven abrasion effectively. This is probably because a contact pressure of the toner seal 32 to the photosensitive drum 14 is increased so as to heighten an effect in which the toner seal 32 breaks the abrasive accumulated on the surface of the photosensitive drum 14. However, if the toner seal 32 is too thick, a load physically applied on the photosensitive drum 14 is excessively increased, and an image failure easily occurs. In the experiment 2, in a case where the toner seal 32 has a thickness thicker than 0.2 mm, a line image was printed on the image.

Experiment 3

An experiment 3 was carried out to demonstrate an effect of the primary transferring bias applied to the primary transferring roller 17 on the uneven abrasion and the filming. In the experiment 3, the photosensitive drum 14 was rotated in the counter direction opposite to the rotation direction at the image forming operation, and then the photosensitive drum 14 was rotated in the same direction as the rotation direction at the image forming operation and the intermediate transferring belt 5 was driven in the same direction as the drive direction at the image forming operation. After that, in each of cases where the primary transferring bias was applied to the primary transferring roller 17 and was not applied, whether the uneven abrasion occurred or not was judged in the same manner as the experiment 2. In the experiment 3, the primary transferring bias applied to the primary transferring roller 17 has an opposite polarity (the same polarity as the polarity of the toner) to the polarity at the image forming operation. Additionally, in the same way as the experiments 1 and 2, whether the filming occurred or not was judged visually. The experiment 3 was carried out by using the image forming apparatus 1 from which the toner seal 32 was detached. A result of the experiment 3 is shown in table 3.

TABLE 3

| Primary transferring bias (μA) | Uneven abrasion | Filming |
|---|---|---|
| Not applied | x | ○ |
| 7 | ○ | ○ |

A mark "○" in a column of "uneven abrasion" in table 3 shows that the uneven abrasion did not occur, and a mark "x" in the column of "uneven abrasion" in table 3 shows that the uneven abrasion occurred. A mark "○" in a column of "filming" in table 3 shows that the filming did not occur. As shown in table 3, by rotating the photosensitive drum 14 in the counter direction opposite to the rotation direction at the image forming operation, it becomes possible to eliminate the occurrence of the filming. However, as long as the primary transferring bias is applied to the primary transferring roller 17, it is impossible to eliminate the uneven abrasion sufficiently. This is probably because when the primary transferring bias is applied to the primary transferring roller 17, the abrasive is transferred from the surface of the photosensitive drum 14 to the intermediate transferring belt 5.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. An image forming apparatus comprising:

an image carrier configured to be rotatable and having a surface on which a toner image is carried;

a transferring member configured to transfer the toner image carried on the surface of the image carrier to a transferred body; and a cleaning device configured to remove the toner remaining on the surface of the image carrier, wherein the cleaning device includes:

a cleaning member configured to come into contact with the surface of the image carrier;

a case configured to hold the cleaning member; and a toner seal arranged at an upstream side of the cleaning member in a rotation direction of the image carrier during an image forming operation and configured to come into contact with the surface of the image carrier so as to seal a gap between the surface of the image carrier and the case, wherein a refresh mode including a first operation and a second operation is executable when the image forming operation is not performed, wherein the first operation is executed such that the image carrier is rotated in a counter direction and for a predetermined distance or longer, the counter direction being a direction opposite to the rotation direction of the image carrier during the image forming operation, the predetermined distance being a distance from a contact position where the cleaning member comes into contact with the surface of the image carrier to a transferring position where the transferring member transfers the toner image, and the second operation is executed such that, after the first operation is completed, the transferred body is driven and the transferring member is applied with transferring bias, and wherein the transferring bias applied to the transferring member during the second operation has an opposite polarity to a polarity of a transferring bias applied to the transferring member during the image forming operation.

2. The image forming apparatus according to claim 1, wherein the second operation is executed after rotation of the image carrier in the counter direction for the first operation is stopped.

3. The image forming apparatus according to claim 1, wherein the second operation is executed while rotation of the image carrier in the counter direction for the first operation is continued.

4. The image forming apparatus according to claim 1, wherein the toner seal has a thickness of 0.1 mm or thicker.

5. The image forming apparatus according to claim 1, wherein the transferring member is a primary transferring roller, and the transferred body is an intermediate transferring belt.

6. The image forming apparatus according to claim 1, wherein when the first operation is executed, the image carrier is rotated in the counter direction and for a distance longer than the predetermined distance.

7. The image forming apparatus according to claim 1, wherein when the first operation is executed, the image carrier is rotated in the counter direction and for a distance equal to the predetermined distance.

8. The image forming apparatus according to claim 1, wherein when the first operation is executed, the drive of the transferred body is stopped.

9. The image forming apparatus according to claim 1, wherein each of the first operation and the second operation is executed once.

10. The image forming apparatus according to claim 1, wherein the first operation and the second operation are executed repeatedly and alternately.

11. The image forming apparatus according to claim 1, wherein the second operation is continuously executed after the first operation is completed.

12. The image forming apparatus according to claim 1, wherein the second operation is executed at a predetermined time after the first operation is completed.

13. An image forming apparatus comprising:

an image carrier configured to be rotatable and having a surface on which a toner image is carried;

a transferring member configured to transfer the toner image carried on the surface of the image carrier to a transferred body; and a cleaning device configured to remove the toner remaining on the surface of the image carrier, wherein the cleaning device includes:

a cleaning member configured to come into contact with the surface of the image carrier;

a case configured to hold the cleaning member; and a toner seal arranged at an upstream side of the cleaning member in a rotation direction of the image carrier during an image forming operation and configured to come into contact with the surface of the image carrier so as to seal a gap between the surface of the image carrier and the case, wherein a refresh mode including a first operation and a second operation is executable when the image forming operation is not performed, wherein the first operation is executed such that the image carrier is rotated in a counter direction and for a predetermined distance or longer, the counter direction being a direction opposite to the rotation direction of the image carrier during the image forming operation, the predetermined distance being a distance from a contact position where the cleaning member comes into contact with the surface of the image carrier to a transferring position where the transferring member transfers the toner image, and the second operation is executed such that, after the first operation is completed, the transferred body is driven and the transferring member is applied with transferring bias, and wherein when the first operation is executed, the transferred body is driven in a rotation direction identical with a rotation direction of the transferred body during the image forming operation.

* * * * *